United States Patent [19]

Burton

[11] Patent Number: 4,603,884

[45] Date of Patent: Aug. 5, 1986

[54] LOTTO TICKET MARKING GUIDE

[76] Inventor: David Burton, 11645 Hubbell, Detroit, Mich. 48227

[21] Appl. No.: 737,100

[22] Filed: May 23, 1985

[51] Int. Cl.[4] ..... B42D 15/00; G09B 11/04

[52] U.S. Cl. ..... 283/1 A; 283/98; 283/903; 434/165

[58] Field of Search ..... 283/6, 8 R, 9 R, 1 A, 283/36, 98, 99, 903; 40/110; 346/139; 132/88.5; 434/164, 165

[56] References Cited

U.S. PATENT DOCUMENTS

| | | | |
|---|---|---|---|
| 447,651 | 3/1891 | Agee | 434/165 |
| 523,906 | 7/1894 | Rush | 434/165 |
| 627,132 | 6/1899 | McBride | 434/165 |
| 748,555 | 12/1903 | Ferguson | 434/165 |
| 1,888,090 | 11/1932 | Linden | 283/98 |
| 1,983,004 | 12/1934 | Rowland | 283/903 |
| 2,760,276 | 8/1956 | Margolius | 434/164 |
| 4,299,637 | 11/1981 | Oberdeck et al. | 283/99 |

*Primary Examiner*—Paul A. Bell
*Assistant Examiner*—Paul M. Heyrana
*Attorney, Agent, or Firm*—Cullen, Sloman, Cantor, Grauer, Scott, & Rutherford

[57] ABSTRACT

A marking guide for an imprinted lotto ticket having a plurality of laterally arranged wager sections, with each section having a plurality of spaced boxes in a row and in a plurality of laterally spaced rows with numerical indicia in each box, includes a flattened sleeve. A guide strip having spaced opposed inturned guide flanges is nested and secured within the sleeve and projects outwardly from one end defining a guide support. An apertured guide block spans the flanges and is secured thereto. The guide block has therethrough a plurality of spaced rectangular slots in a row and in a plurality of laterally spaced rows corresponding respectively to the boxes in each wager section to facilitate marking the boxes in each section through the slots as the lotto ticket is inserted into the guide strip with the wager sections successively underlying the guide block.

3 Claims, 3 Drawing Figures

FIG. 1
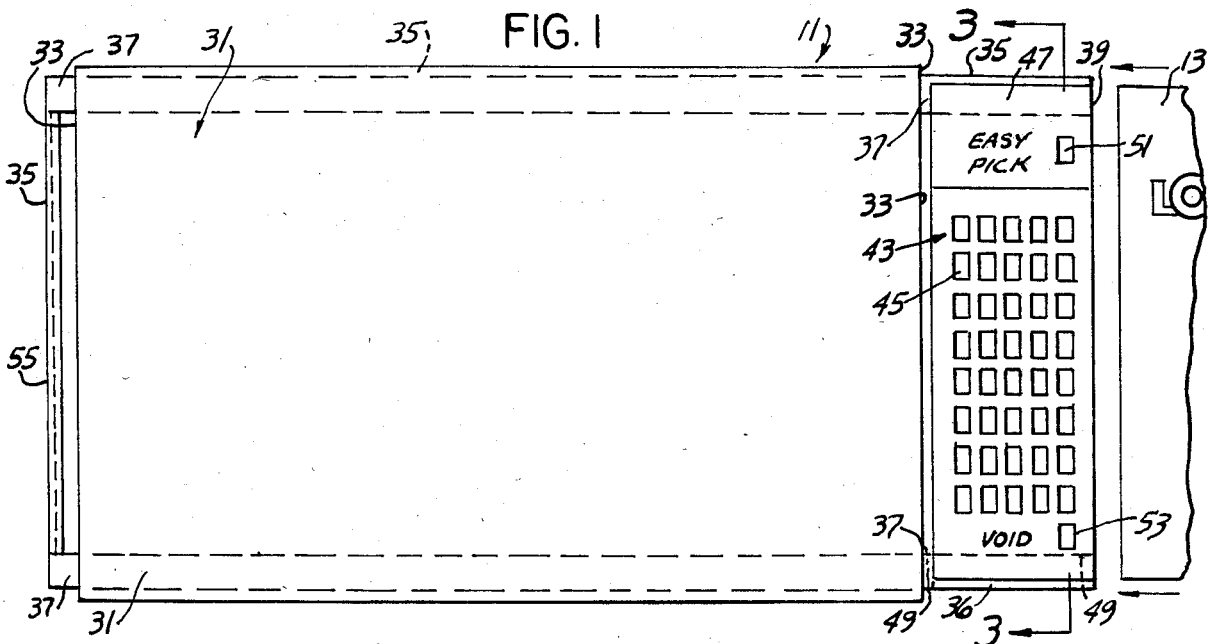
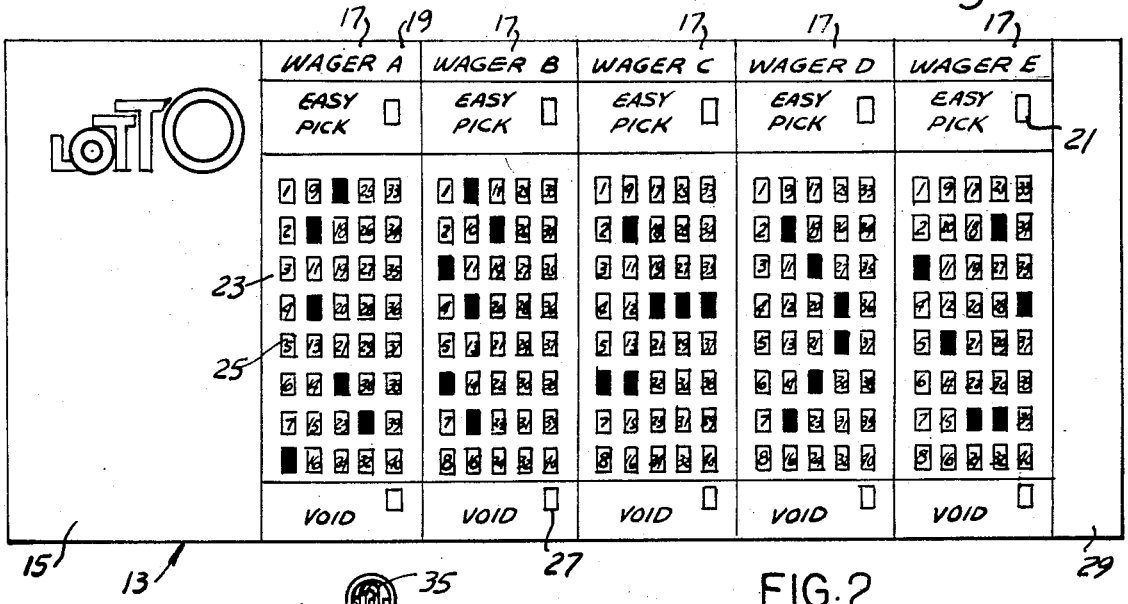
FIG. 2
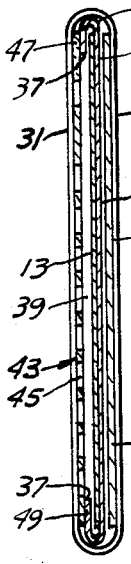
FIG. 3

LOTTO TICKET MARKING GUIDE

This invention relates to the marking guide for lotto tickets having a series of imprinted wager sections with longitudinally spaced boxes arranged in lateally spaced rows and with numerical indicia in each box and wherein upon a suitable support sleeve and a guide strip projecting therefrom therein there is mounted an apertured guide block having a series of longitudinally spaced laterally arranged rows of guide slots to facilitate the marking through the slots of the corresponding underlying boxes of a lotto ticket successively advanced thereunder.

BACKGROUND OF THE INVENTION

In connection with the very popular lotto wager game as presently provided imprinted lotto tickets have thereon a series of laterally arranged wager sections and within each section longitudinally spaced boxes in a row and in laterally spaced rows with numerical indicia in each box. In most lotto games, each wager section has marked thereon by the ticket holder a series of boxes corresponding to six numbers for illustration.

While the objective is to fully fill in the corresponding box so as to provide a machine readable wager section, often times the user fails to fully fill in the box substituting merely a line such that the marked up box is not properly machine readable as it would be if the box were completely filled in to its perimeter.

For those that have tried to mark the card correctly, considerable effort is required to keep the marking within the boundary of the box so as to provide a completely machine readable wager section and series of sections upon the ticket for a presentation to the computer type of lottery machine.

In normal operation, the computer electronically reads the preselected six numbers for each section and provides a print out ticket for the holder which includes imprinted thereon the numbers corresponding to the preselected wager sections upon payment of a predetermined amount for each wager section.

Heretofore with the manual free hand marking with a pencil or a pen of the wager sections of the lotto ticket, difficulties often arise in properly filling in and providing a rectangular opaque area fully within the respective boxes to provide machine readable elements translated by the computer into numbers which are to be imprinted upon a receipt card.

SUMMARY OF THE INVENTION

An important feature of the present invention is to provide a marking guide for lotto tickets such as will facilitate the complete filling in of the respective boxes of each wager section of the lotto ticket.

Another feature is to provide a marking guide for a lotto ticket wherein there is provided a tubular support for guidably receiving the ticket from one end thereof and mounted upon the support outwardly thereof, there is provided a relatively stiff apertured guide block having a series of spaced rectangular slots therein formed in a row and in laterally spaced rows which correspond to the rows of boxes of any wager section to facilitate the manual filling in of the respective boxes by marking each wager section of the ticket through respective preselected slots in the guide block.

An important feature is to provide a marking guide for a lotto ticket which includes the flattened elongated sleeve within which is projected and secured the elongated channel guide having inturned guide flanges with the channel guide projecting outwardly of the sleeve providing a marking guide support. The apertured guide block spans the flanges of the guide strip and has formed therein a plurality of longitudinally spaced slots arranged in laterally related rows corresponding to the respective boxes of each wager section. Upon progressive insertion of the lotto card into the channel guide, the respective wager sections are successively brought into registry with the guide block for marking therethrough of the underlying boxes of a wager section, and successively as the lotto ticket is advanced longitudinally into the guide strip to the corresponding additional wager sections underlying the respective slots of the guide block.

Another feature is to provide a simple and inexpensive marking guide for lotto tickets wherein instead of the free hand marking of lotto ticket boxes, a marking guide provides a series of apertures of the correct dimension such that by moving the marker within the corresponding slots of the marking guide, the respective underlying boxes of a wager section are completely filled in to provide a machine readable assembly of boxes for each wager section.

These and other features and objects will be seen from the following Specification and claims in conjunction with the accompanying drawing.

THE DRAWING

FIG. 1 is a plan view of the present marking guide for a lotto ticket with a portion of the lotto ticket shown just before insertion therein.

FIG. 2 is a plan view of a conventional lotto ticket.

FIG. 3 is a section taken in the direction of arrows 3—3 of FIG. 1.

It will be understood that the above drawing illustrates merely a preferred embodiment of the invention and that other embodiments are contemplated within the scope of the claims hereinafter set forth.

DETAILED DESCRIPTION OF AN EMBODIMENT OF THE INVENTION

Referring to the drawing, the present lotto ticket marking guide is generally indicated at 11, FIG. 1, adapted to receive lotto ticket 13, FIG. 2.

Said lotto ticket is of a conventional construction in use in many states. The illustrative lotto ticket 13 is the one used in the State of Michigan for illustration, though not limited thereto. The lotto ticket includes a rectangular paper strip 15 which has imprinted thereon a series of laterally arranged wager sections 17 marked with identifying indicia 19 to designate wager sections A, B, C, D and E. On each wager section there is imprinted an "easy pick" box 21 and at the bottom of each wager section, a "void" box 27.

Imprinted upon each wager section 17 of strip 15 of said wager strip are a series of longitudinally spaced boxes 23 arranged in a row and in a plurality of laterally spaced rows, FIG. 2. In the illustrative embodiment the respective boxes are of rectangular shape and have imprinted within said boxes the indicia 1 through 40, for illustration, for the respective wager sections 17.

The respective wager sections 17 are imprinted upon lotto ticket 13 side by side so as to define at one end of the ticket a grip strip 29.

The present lotto ticket marking guide includes an elongated flattened sleeve 31 having top and bottom sides which is open at one end as at 33. The opposite end of the sleeve casing 31 may also be open at 33 if desired.

The elongated channel guide strip 35 includes a pair of spaced oppositely arranged inturned ticket guide flanges 37. These flanges define at one end of the guide strip 35 a marking guide support 36 laterally outward of the open end 33. The respective flanges 37 define with channel guide strip 35 the ticket entrant opening 39, FIGS. 1 and 3, adapted to receive one end of lotto ticket 13, fragmentarily shown.

Channel guide strip 35 is suitably secured upon the interior of sleeve casing 31 by a suitable adhesive. In the illustrative embodiment, an adhesive strip or strips of adhesive 49 are applied over the respective flanges 37 for engaging registry with portions of sleeve casing 31, as for example a top surface thereof.

Upright guide block 43 of the relatively stiff material as for example a molded plastic material spans one end of the channel guide strip 35 extends between and overlies the respective flanges 37 at the marking guide support 36. Guide block 43 is suitably secured over the corresponding flanges 37 by an adhesive strip at 49, FIG. 1. Guide block 43 has formed or molded therein a plurality of longitudinally spaced rectangular slots or openings 45. Said slots are of rectangular shape and are the same size and correspond to the shape and location of the corresponding boxes 23 within the respective wager sections 17 of lotto ticket 13. Guide block 43 has formed therethrough "easy pick" slot 51 and spaced therefrom a "void" slot 53 which are adapted upon insertion of the card 13 in the direction of the arrow in FIG. 1 into the channel guide strip 35 for registering with the corresponding "easy pick" and "void" boxes 21, 27 of each wager section. In the illustrative embodiment the respective rectanglur slots 45 of the guide block are so arranged as to be in lateral alignment with the corresponding rows of boxes 23 of the respective wager sections.

In order to use the present marking guide, the lotto ticket is held at grip strip 29 thereon at one end and the opposite end of the lotto ticket is inserted into entrant opening 39 in channel guide 35 defined by the pair of opposed flanges 37.

In operation the lotto ticket is longitudinally inserted into entrant opening 39 until the wager section 17-A is underlying registry with the corresponding slots in guide block 43. With such registry the corresponding boxes 23 and indicia 25 of wager section 17-A directly underlies and are in cooperative registry with the corresponding slots 45 of said guide block.

At this point the holder of the blank lotto ticket applies a pencil and pen to those predetermined slots 45 of the guide block 43 so as to provide a series of preselected numbers such as shown by the corresponding marked in boxes 23 for wager section 17-A.

The pencil or pen is applied to the guide edges which define the respective slots 45 in the guide block such that the complete respective boxes 23 of a corresponding wager section are completely filled in and dark.

After this is done the ticket is manually advanced longitudinally inward relative to sleeve 31 and channel guide 35 until the wager section 17 and the imprinted boxes therein respectively underlie the corresponding slots 45 of said guide block. At that time using a pencil or a pen the wager section B is filled in with the respective corresponding preselected boxes 23 fully marked to the margins thereof, FIG. 2.

Eventually after each wager section has been marked, the lotto ticket 13 is longitudinally advanced further until the final wager section E underlies and is in registry with guide block 43. The guide block is used to guide the marking upon wager section 17E. In the illustrative embodiment, one end of the channel guide strip 35 is inturned at 55 thereby providing a positive stop for lotto ticket strip 15. At said positive stop wager section 17E is exactly in underlying registry with the corresponding slots 45 of the guide block 43 for the final marking of the lotto ticket.

Using the present guide in marking up lotto ticket 13, it is apparent that each of the respective wager Sections 17-A through E are clearly filled in by the pencil or pen such as to provide machine readable opaque numbers for the computer such as are used at lottery ticket stations.

The present invention is primarily directed to a marking guide for lottery tickets wherein the user has a means of properly marking up the bet slip or lottery ticket so that it is accepted by the computer and provides machine readable rectangular designations to which the computer receiver will respond and to provide the proper ticket imprint receipt with numbers thereon corresponding to those selected by the user and shown on the lotto ticket before insertion into the computer equipment.

This represents an improvement over the hand marking of the individual boxes of each wager section and provides a guide by which there is a fully opaque fill in by pen or pencil of the corresponding boxes, in this case six boxes for each wager section. It is contemplated as a part of the present invention that there could be more or less wager sections than shown.

In use, should the ticket holder wish some or all of the wager sections to be automatically determined by the computer, all that is necessary is to blacken in the corresponding "easy pick" box 21 using the corresponding guide slot 51 of guide block 43, FIG. 1. Similarly, had an error been committed for example, or more than six numbers marked upon a particular wager section, that particular wager can be voided by blocking out the box 27 of the specific wager section 17 through the corresponding guide slot 53 of guide block 43.

The space between the underside of channel guide 35 and sleeve 31 provides a storage chamber 55' for lotto tickets 13.

Having described my invention, reference should now be had to the following claims.

I claim:

1. A marking guide for a lotto ticket having a plurality of laterally arranged imprinted wager sections, with each section having a plurality of longitudinally spaced imprinted boxes in a row and in a plurality of laterally spaced rows, with numerical indicia imprinted in each box, comprising an elongated flattened sleeve open at one end and including top and bottom surfaces;

an elongated channel guide strip having spaced opposed inturned guide flanges nested and secured within said sleeve and projected outwardly of one end thereof providing a marking guide support and a lotto ticket entrant opening in said guide strip between said flanges;

an apertured guide block of a stiff material transversely spanning said guide strip and at its ends mounted upon and secured to said flanges upon said marking guide support;

said guide block having therethrough a plurality of longitudinally spaced rectangular slots in a row and in a plurality of laterally spaced rows corresponding to and adapted for juxtaposition over the rows of boxes of any wager section;

said lotto ticket adapted for lateral projection into said entrant opening so that one of said wager sections underlies said guide block;

whereby the ticket holder by applying a marker through preselected slots corresponding to a preselected series of indicia fills in the corresponding underlying boxes of said wager section;

and on longitudinal incremental advancing of said ticket into said channel guide successive underlying wager sections, respectively;

said wager sections being arranged side by side and with the corresponding slots in said guide block being aligned with the respective rows of boxes of said wager sections.

2. In the marking guide of claim 1, the securing of said channel guide including a strip of adhesive along its flanges in registry with said sleeve.

3. In the marking guide of claim 1, an inturned edge along the inner end of said channel guide adapted for registry with one end of said lotto ticket so that the last wager section is in registry with the slots in said guide block.

* * * * *